US008098162B2

(12) United States Patent
Abbott et al.

(10) Patent No.: US 8,098,162 B2
(45) Date of Patent: Jan. 17, 2012

(54) ATTACHMENT OF AN RFID TAG TO A CONTAINER

(75) Inventors: Douglas W. Abbott, Bowling Green, OH (US); John M. Shingle, Perrysburg, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 636 days.

(21) Appl. No.: 12/079,843

(22) Filed: Mar. 27, 2008

(65) Prior Publication Data

US 2009/0242446 A1 Oct. 1, 2009

(51) Int. Cl.
*G08B 13/14* (2006.01)

(52) U.S. Cl. ..... 340/572.8; 340/5.92; 340/572.1; 264/509

(58) Field of Classification Search ..... 340/572.8, 340/5.92, 572.1; 422/102; 235/385, 492; 264/293, 320, 322, 509; 428/34.1
See application file for complete search history.

(56) References Cited

U.S. PATENT DOCUMENTS

| | | | | |
|---|---|---|---|---|
| 582,758 | A | 5/1897 | McLaughlin | |
| 4,889,619 | A * | 12/1989 | Lynch | 209/374 |
| 5,312,011 | A * | 5/1994 | Fischer | 220/528 |
| 6,191,691 | B1 * | 2/2001 | Serrault | 340/572.8 |
| 6,652,812 | B1 * | 11/2003 | Vartiainen et al. | 422/102 |
| 7,070,053 | B1 | 7/2006 | Abrams et al. | |
| 7,091,864 | B2 | 8/2006 | Veitch et al. | |
| 2001/0028308 | A1 | 10/2001 | De La Huerga | |
| 2004/0008123 | A1 | 1/2004 | Carrender et al. | |
| 2007/0036686 | A1 | 2/2007 | Hatamian et al. | |
| 2007/0182562 | A1 | 8/2007 | Abbott et al. | |
| 2008/0131629 | A1 * | 6/2008 | Chisholm et al. | 428/34.1 |
| 2008/0218348 | A1 * | 9/2008 | August et al. | 340/572.1 |
| 2008/0284567 | A1 * | 11/2008 | Portier et al. | 340/10.1 |

FOREIGN PATENT DOCUMENTS

| | | |
|---|---|---|
| EP | 1767461 A2 | 3/2007 |
| NL | 1010946 A1 | 3/1999 |
| WO | WO 2004/008387 | 1/2004 |

* cited by examiner

*Primary Examiner* — George Bugg
*Assistant Examiner* — Hongmin Fan
(74) *Attorney, Agent, or Firm* — Reisig Ethington PC

(57) ABSTRACT

A container includes a container body having a sidewall and an end wall extending across the sidewall and closing an end of the container body. A retainer is received on the container body with a central portion of the retainer adjacent to the end wall of the container body and a flexible edge portion of the retainer engaging the sidewall of the container body at an angle to resist removal of the retainer away from the end wall. An RFID tag is disposed between the central portion of the retainer and the end wall of the container body. The retainer and the RFID tag may be disposed outside of the container body interior, but more preferably are disposed within the container body interior. The retainer preferably is imperforate, and the edge portion of the retainer preferably is in continuous peripheral contact with the container sidewall to seal the RFID tag from the container interior. In a preferred implementation, the container body is a molded plastic prescription vial having an annular sidewall, and the retainer is in continuous annular contact with the interior surface of the container sidewall to seal the RFID tag from the container interior.

19 Claims, 2 Drawing Sheets

ATTACHMENT OF AN RFID TAG TO A CONTAINER

The present disclosure relates to a container, particularly a prescription vial, with an RFID tag attached to the container after fabrication of the container.

BACKGROUND AND SUMMARY OF THE DISCLOSURE

It has been proposed to place a radio frequency identification (RFID) tag on or in a wall of a container to confirm the genuineness of the package that includes the container and/or to provide other information concerning the package or a product within the package. A general object of the present disclosure is to provide a mechanism for attaching an RFID tag to a container, particularly a prescription vial, after fabrication of the container.

The present disclosure embodies a number of aspects that can be implemented separately from or in combination with each other.

A container in accordance with one aspect of the present disclosure includes a container body having a sidewall and an end wall extending across the sidewall and closing an end of the container body. A retainer is received on the container body with a central portion of the retainer adjacent to the end wall of the container body and a flexible edge portion of the retainer engaging the sidewall of the container body at an angle to resist removal of the retainer away from the end wall. An RFID tag is disposed between the central portion of the retainer and the end wall of the container body. The retainer and the RFID tag may be disposed outside of the container body interior, but more preferably are disposed within the container body interior. The retainer preferably is imperforate, and the edge portion of the retainer preferably is in continuous peripheral contact with the container sidewall to seal the RFID tag from the container interior. In a preferred implementation, the container body is a molded plastic prescription vial having an annular sidewall, and the retainer is in continuous annular contact with the interior surface of the container sidewall to seal the RFID tag from the container interior.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
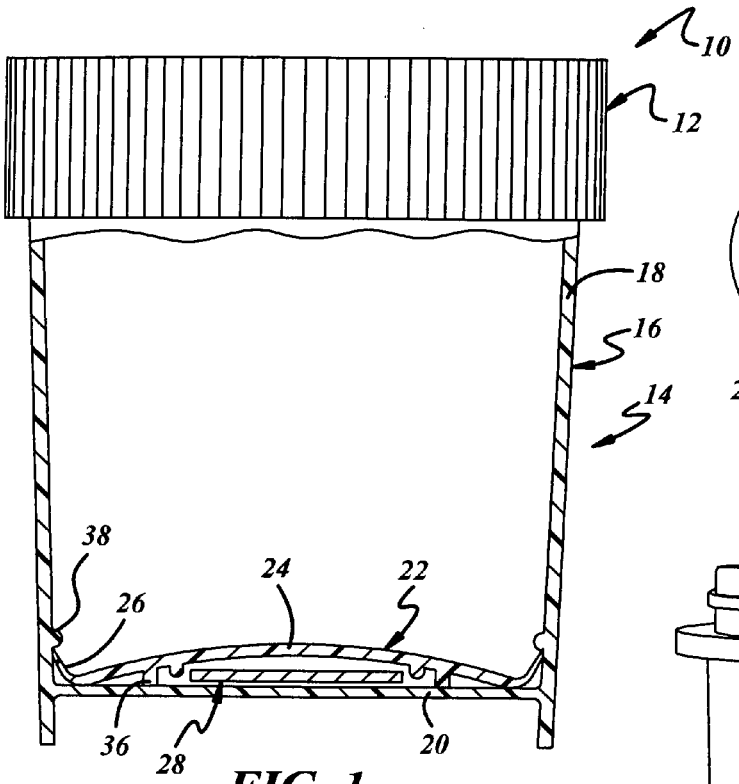
FIG. 1 is a partially sectioned elevational view of a package that includes a container in accordance with an exemplary embodiment of the present disclosure.

FIG. 1 illustrates a package 10 in accordance with an exemplary embodiment of the present disclosure as including a closure 12 applied to the neck finish of a container 14. Container 14 includes a container body 16 that preferably is a prescription vial of molded plastic construction such as polypropylene. Container body 16 has an annular sidewall 18 that preferably is cylindrical or slightly conical, and an end wall 20 extending across sidewall 18 and closing one end of container body 16.

Figure 2:
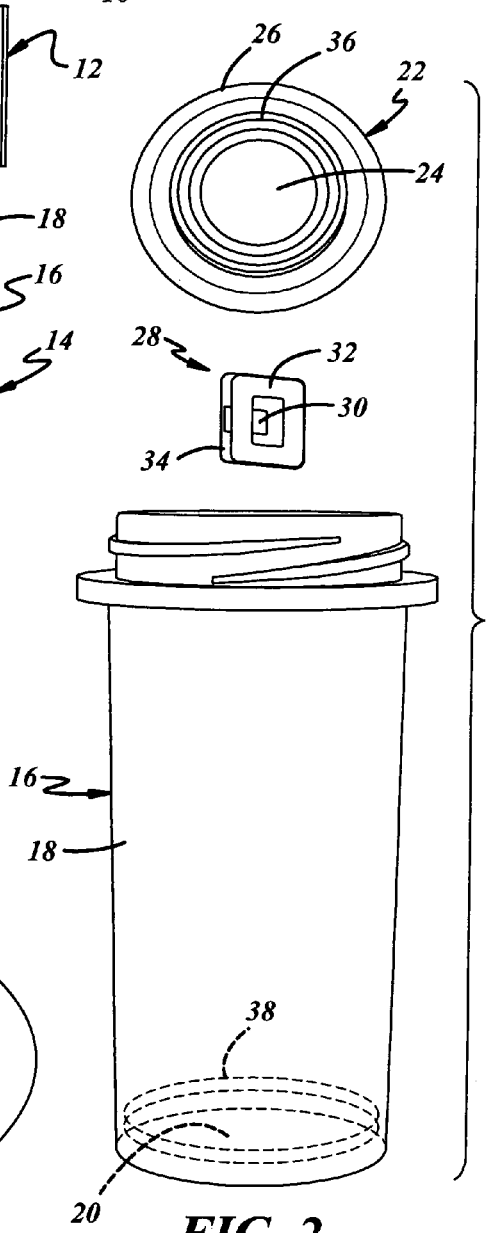
FIG. 2 is an exploded elevational view of the container in the package of FIG. 1.

A retainer 22 is disposed within container body 16 in the embodiment of FIGS. 1-2. Retainer 22 preferably is of one-piece molded plastic construction such as polyethylene. Retainer 22 preferably has a domed central portion 24, and a flexible peripheral edge portion 26 integral with and at an angle to central portion 24. In the preferred implementation in combination with annular container bodies 16, central retainer portion 24 is circular and flexible peripheral edge portion 26 is annular. Retainer 22 is inserted into container body 16 such that retainer edge portion 26 is in annular contact with the inside surface of container sidewall 18 and central portion 24 is adjacent to container body end wall 20.

An RFID inlay 28 is disposed between retainer 22 and container end wall 20. Inlay 28 preferably includes an RFID tag 30 electrically connected to an antenna 32, with both being disposed on a substrate 34. An annular wall 36 on retainer 22 engages container end wall 20 and captures inlay 28 between retainer 22 and end wall 20. Friction fit between retainer edge portion 26 and the opposing inside surface of container sidewall 18 holds retainer 22 and RFID inlay 28 in position within container body 16. Retainer 22 preferably is imperforate so that RFID inlay 28 is sealed from the interior of container body 16. A particular advantage of the present disclosure is that retainer 22 and inlay 28 can be employed in conjunction with existing designs of container body 16 without any modification to the existing container body. However, a segmented or continuous internal bead 38 can be provided on container body sidewall 18 at a position spaced from end wall 20 for engagement by retainer edge portion 26 to enhance capture of retainer 22 and inlay 28 within the container body.

Figure 3:
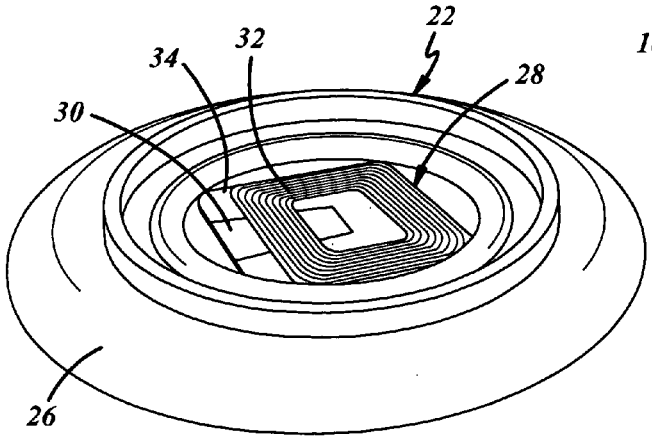
FIG. 3 is a perspective view of a modification to the container of FIGS. 1 and 2.
Figure 4:
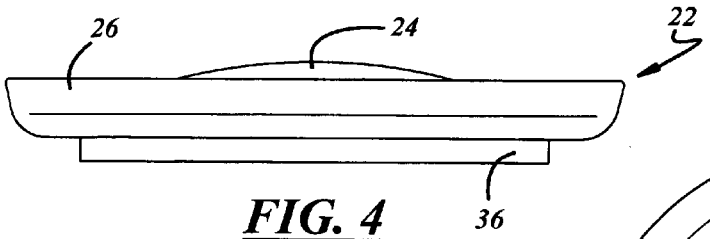
FIG. 4 is a side elevational view of the retainer in the container of FIGS. 1-2.
Figure 5:
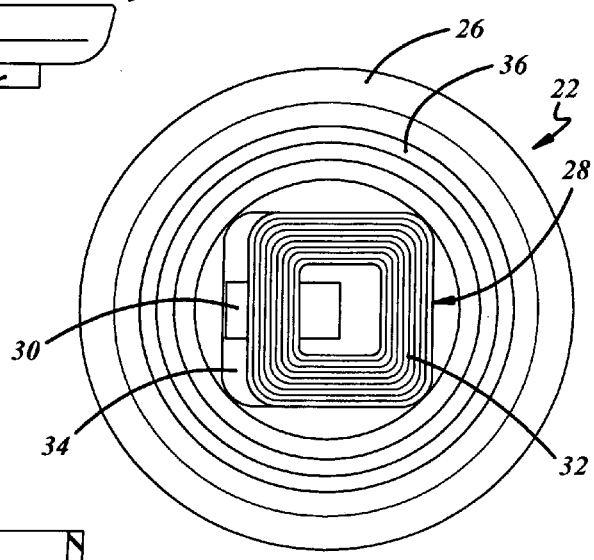
FIG. 5 is a bottom plan view of the retainer in FIG. 4.

RFID tag 30 and inlay 28 can be loosely captured between retainer 22 and container end wall 20. Inlay 28 and RFID tag 30 could be adhered to the concave interior of retainer central portion 24 or molded into retainer central portion 24 as illustrated in FIG. 3.

Figure 6:
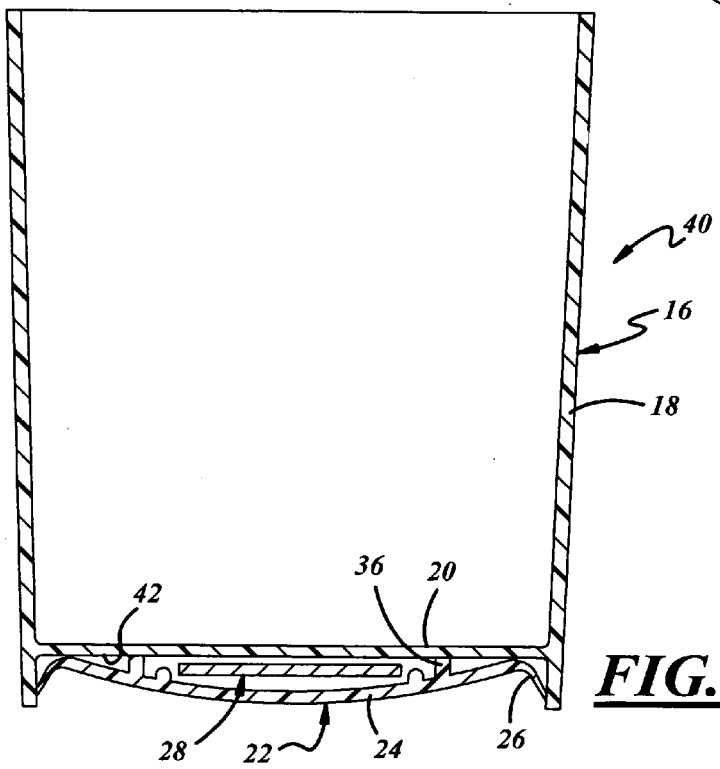
FIG. 6 is a sectional view of a container in accordance with a second exemplary embodiment of the present disclosure.

FIG. 6 illustrates a container 40 in accordance with a second exemplary embodiment of the present disclosure as including a container body 16 in which the sidewall 18 extends beyond end wall 20 to form a cavity 42 beneath end wall 20. Retainer 22 and inlay 28 can be disposed within cavity 42, with container edge portion 26 in angled frictional contact with the inside surface of the container sidewall extension. The embodiment of FIG. 6 has the advantage that the retainer and the RFID tag (and inlay) are disposed outside of the container interior so that no issues are presented relative to the materials of the retainer and the inlay in contact with the product within the container.

There thus has been disclosed a container with attached RFID tag that fully satisfies all of the objects and aims previously set forth. The disclosure has been presented in conjunction with exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A container that includes:

a container neck finish for application of a closure thereto, and a container body having a sidewall and an end wall extending across said sidewall and closing an end of said container body, a retainer having a central portion and a flexible edge portion, said retainer being received in said container body with said central portion adjacent to said end wall and said flexible edge portion engaging said sidewall at an angle and in angled frictional contact with an inside surface of said sidewall to resist removal of said retainer away from said end wall, and an RFID tag between said central portion of said retainer and said end wall of said body, wherein said end wall and said sidewall define an interior volume of said container body, and wherein said RFID tag and said retainer are disposed within said interior volume.

2. The container set forth in claim 1 wherein said retainer is imperforate.

3. The container set forth in claim 2 wherein said sidewall is annular, said retainer central portion is circular, and said retainer edge portion is annular and in continuous annular contact with an inside surface of said sidewall.

4. The container set forth in claim 3 wherein said central portion is dished away from said end wall and overlies said RFID tag.

5. The container set forth in claim 4 wherein said central portion includes an annular wall engaged with said end wall of said container body and encircling said RFID tag.

6. The container set forth in claim 5 wherein said RFID tag is on an inlay disposed between said insert and said end wall.

7. The container set forth in claim 1 wherein said retainer is imperforate and said flexible edge portion is in continuous peripheral contact with said sidewall to seal said inlay from said interior volume.

8. The container set forth in claim 1 including an internal bead on said sidewall engaged by said edge portion of said retainer to resist removal of said retainer from within said container body.

9. A container that includes:

a container neck finish for application of a closure thereto, and a container body having a sidewall and an end wall extending across said sidewall and closing an end of said container body, a retainer having a central portion and a flexible edge portion, said retainer being received on said container body with said central portion adjacent to said end wall and said flexible edge portion engaging said sidewall at an angle and in angled frictional contact with an inside surface of said sidewall to resist removal of said retainer away from said end wall, and an RFID tag between said central portion of said retainer and said end wall of said body, wherein said end wall and said sidewall define an interior volume of said container body with said sidewall extending beyond said end wall away from said interior volume to define a cavity beneath said end wall, and wherein said retainer and said RFID tag are disposed outside of said interior volume within said cavity.

10. The container set forth in claim 9 wherein said RFID tag is secured to said retainer.

11. The container set forth in claim 10 wherein said RFID tag is molded into said retainer.

12. A container that includes:

a container neck finish for application of a closure thereto, and a container body having an annular sidewall and an end wall extending across said sidewall and closing an end of said container body, and defining an interior volume of said container body, a retainer having a circular central portion and an annular flexible edge portion surrounding and integral with said central portion, said retainer being received within said interior volume of said container body with said central portion disposed adjacent to said end wall and said edge portion in continuous annular contact with an inside surface of said sidewall at an angle and in angled frictional contact with an inside surface of said sidewall to resist removal of said retainer from within said container body, and an RFID tag captured between said central portion of said retainer and said end wall of said body and sealed by said retainer from an interior of said container body.

13. The container set forth in claim 12 wherein said central portion of said retainer is domed away from said end wall and has an annular wall in engagement with said end wall encircling said RFID tag.

14. The container set forth in claim 13 wherein said RFID tag is on an inlay disposed between said retainer and said end wall.

15. The container set forth in claim 12 wherein said RFID tag is secured to said retainer.

16. The container set forth in claim 12 including an internal bead on said sidewall engaged by said edge portion of said retainer to hold said retainer within said container body.

17. The container set forth in claim 1 wherein said container is a prescription vial.

18. The container set forth in claim 9 wherein said container is a prescription vial.

19. The container set forth in claim 12 wherein said container is a prescription vial.

* * * * *